US010766254B2

(12) United States Patent
Takahashi

(10) Patent No.: US 10,766,254 B2
(45) Date of Patent: Sep. 8, 2020

(54) LIQUID DISCHARGE APPARATUS, LIQUID DISCHARGE SYSTEM, AND LIQUID DISCHARGE METHOD

(71) Applicant: Hiroki Takahashi, Kanagawa (JP)

(72) Inventor: Hiroki Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/285,670

(22) Filed: Feb. 26, 2019

(65) Prior Publication Data

US 2019/0283410 A1 Sep. 19, 2019

(30) Foreign Application Priority Data

Mar. 19, 2018 (JP) ..... 2018-051784

(51) Int. Cl.

| | |
|---|---|
| ***B41J 2/15*** | (2006.01) |
| ***B41J 2/045*** | (2006.01) |
| ***B41J 29/377*** | (2006.01) |
| ***B41J 29/38*** | (2006.01) |
| ***B41J 2/21*** | (2006.01) |

(52) U.S. Cl.

CPC ..... *B41J 2/04588* (2013.01); *B41J 2/04563* (2013.01); *B41J 2/04573* (2013.01); *B41J 2/04581* (2013.01); *B41J 2/04593* (2013.01); *B41J 2/15* (2013.01); *B41J 2/2103* (2013.01); *B41J 2/2132* (2013.01); *B41J 29/377* (2013.01); *B41J 29/38* (2013.01)

(58) Field of Classification Search

CPC ..... B41J 2/04563; B41J 2/04573; B41J 2/04581; B41J 2/04593; B41J 2/15; B41J 2/2103; B41J 2/2132

See application file for complete search history.

(56) References Cited

U.S. PATENT DOCUMENTS

| | | | |
|---|---|---|---|
| 6,325,478 | B1 | 12/2001 | Imai et al. |
| 2010/0265291 | A1 | 10/2010 | Mano |
| 2016/0236466 | A1 | 8/2016 | Takahashi et al. |
| 2017/0165962 | A1 | 6/2017 | Mizutani et al. |

FOREIGN PATENT DOCUMENTS

| | | |
|---|---|---|
| JP | 9-057953 | 3/1997 |
| JP | 9-191397 | 7/1997 |
| JP | 2000-108386 | 4/2000 |
| JP | 2000-190478 | 7/2000 |
| JP | 2013006285 A | 1/2013 |

OTHER PUBLICATIONS

Extended European Search Report dated Jul. 9, 2019, issued in corresponding European Patent Application No. 19159255.9.

*Primary Examiner* — Lamson D Nguyen

(74) *Attorney, Agent, or Firm* — Harness, Dickey and Pierce, P.L.C.

(57) ABSTRACT

A liquid discharge apparatus includes a liquid discharge head configured to discharge liquid onto an object in accordance with a discharge cycle signal, image data, and a drive waveform; and a carriage on which the liquid discharge head is mounted. The carriage is configured to scan the object in a predetermined direction. The liquid discharge apparatus further includes circuitry configured to output pattern data for decimating the discharge cycle signal, the image data, and the drive waveform in accordance with a number of scans performed by the carriage to form a line of an image. The circuitry is configured to decimate the discharge cycle signal in accordance with the pattern data.

10 Claims, 11 Drawing Sheets

FIG. 9

| RESOLUTION | 0xFF (WITHOUT DECIMATION) | 0xAA (1/2 DECIMATION) | 0x88 (3/4 DECIMATION) |
|---|---|---|---|
| 1200 dpi | 200 mm/s | 400 mm/s | 800 mm/s |
| 600 dpi | 500 mm/s | 1000 mm/s | 2000 mm/s |

| RESOLUTION | 0xFF (WITHOUT DECIMATION) | 0xAA (1/2 DECIMATION) | 0x88 (3/4 DECIMATION) |
|---|---|---|---|
| 1200 dpi | 0.5 $m^3$/min(3.3W) | 0.2 $m^3$/min(1.33W) | 0.1 $m^3$/min(0.67W) |
| 600 dpi | 0.3 $m^3$/min(2W) | 0.1 $m^3$/min(0.67W) | 0.05 $m^3$/min(0.33W) |

LIQUID DISCHARGE APPARATUS, LIQUID DISCHARGE SYSTEM, AND LIQUID DISCHARGE METHOD

CROSS-REFERENCE TO RELATED APPLICATION

This patent application is based on and claims priority pursuant to 35 U.S.C. § 119(a) to Japanese Patent Application No. 2018-051784, filed on Mar. 19, 2018, in the Japan Patent Office, the entire disclosure of which is hereby incorporated by reference herein.

BACKGROUND

Technical Field

The present disclosure relates to a liquid discharge system, a liquid discharge apparatus, and a liquid discharge method.

Description of the Related Art

When an image with a high-resolution setting is printed by a conventional serial inkjet printer, a technique of multi-pass printing is used to perform a rendering process to divide an original image into pieces of image data corresponding to respective scans, and complete an image by performing a plurality of scans. In this technique, an upper limit is imposed on the drive frequency of an inkjet recording head. Therefore, the speed at which the recording head is carried decreases as the resolution of an image to be formed increases.

To perform high-speed printing, there is a technique of thinning out dots (reducing the number of dots or decimation) to increase the head drive frequency.

SUMMARY

According to an embodiment of this disclosure, a liquid discharge apparatus includes a liquid discharge head configured to discharge liquid onto an object in accordance with a discharge cycle signal, image data, and a drive waveform; and a carriage on which the liquid discharge head is mounted. The carriage is configured to scan the object in a predetermined direction. The liquid discharge apparatus further includes circuitry configured to output pattern data for decimating the discharge cycle signal, the image data, and the drive waveform in accordance with a number of scans performed by the carriage to form a line of an image. The circuitry is configured to decimate the discharge cycle signal in accordance with the pattern data.

Another embodiment provides a liquid discharge apparatus that includes the liquid discharge head and the carriage described above. The liquid discharge apparatus further includes circuitry configured to receive pattern data for decimating the discharge cycle signal, the image data, and the drive waveform in accordance with a number of scans performed by the carriage to form a line of an image. The circuitry is configured to decimate the discharge cycle signal in accordance with the pattern data.

In yet another embodiment, a liquid discharge system includes one of the above-described liquid discharge apparatuses.

Yet another embodiment provides a method for discharging liquid onto an object with a liquid discharge head mounted on a carriage that scans the object in a predetermined direction. The method includes discharging the liquid onto the object in accordance with a discharge cycle signal, image data, and a drive waveform; outputting pattern data for decimating the discharge cycle signal, the image data, and the drive waveform in accordance with a number of scans performed by the carriage to form a line of an image; and decimating the discharge cycle signal in accordance with the pattern data.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 9 is a diagram illustrating an example operation of a carriage controller;

DETAILED DESCRIPTION

Figure 1:
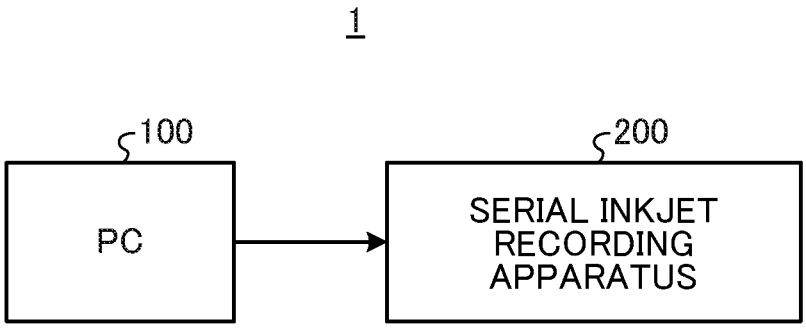
FIG. 1 is a block diagram illustrating an example of a general arrangement of a liquid discharge system according to an embodiment.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below. As used herein, the singular forms "a", "an", and "the" are intended to include the plural forms as well, unless the context clearly indicates otherwise.

The following is a detailed description of liquid discharge systems, liquid discharge apparatuses, and liquid discharge methods as embodiments of this disclosure.

In the present specification, the liquid discharge apparatus includes a liquid discharge head or a liquid discharge device (unit) and drives the liquid discharge head to discharge liquid. The term "liquid discharge apparatus" used here includes, in addition to apparatuses to discharge liquid to materials to which the liquid can adhere, apparatuses to discharge the liquid into gas (air) or liquid.

The liquid discharge apparatus may include at least one of devices to feed, convey, and discharge the material to which liquid can adhere. The liquid discharge apparatus may further include at least one of a pretreatment apparatus and a post-processing apparatus.

As the liquid discharge apparatuses, for example, there are image forming apparatuses to discharge ink onto sheets to form images and three-dimensional fabricating apparatuses to discharge molding liquid to a powder layer in which powder is molded into a layer-like shape, so as to form three-dimensional fabricated objects.

The "liquid discharge apparatus" is not limited to an apparatus to discharge liquid to visualize meaningful images, such as letters or figures. For example, the liquid discharge apparatus may be an apparatus to form meaningless images, such as meaningless patterns, or fabricate meaningless three-dimensional images.

The above-mentioned term "material to which liquid can adhere" represents a material which liquid can, at least temporarily, adhere to and solidify thereon, or a material into which liquid permeates. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

The above-mentioned "material to which liquid adheres" may be any material, such as paper, thread, fiber, cloth, leather, metal, plastic, glass, wood, ceramics, or the like, as long as liquid can temporarily adhere.

Further, the term "liquid" includes any liquid having a viscosity or a surface tension that can be discharged from the head. The "liquid" is not limited to a particular liquid and may be any liquid having a viscosity or a surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

The "liquid discharge apparatus" may be an apparatus in which the liquid discharge head and a material to which liquid can adhere move relatively to each other. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the sheet with the treatment liquid to reform the sheet surface and an injection granulation apparatus to discharge a composition liquid including a raw material dispersed in a solution from a nozzle to mold particles of the raw material.

The terms "image formation", "print", "printing", and the like used in this specification are synonymous.

Further, "resolution" used in this specification represents the resolution set in the print settings.

In the description below, a serial type inkjet recording apparatus will be described as an example of "an apparatus that discharges liquid (a liquid discharge apparatus)". In the serial type inkjet recording apparatus described below, an inkjet recording head is equivalent to a "liquid discharge head".

In the description below, a serial inkjet recording apparatus will be described as an example of "an apparatus that discharges liquid (a liquid discharge apparatus)". In the serial inkjet recording apparatus described below, an inkjet recording head is equivalent to a "liquid discharge head".

Embodiment 1

FIG. 1 is a block diagram illustrating an example of a general configuration of a liquid discharge system according to the present embodiment. A liquid discharge system 1 illustrated in FIG. 1 includes a personal computer (PC) 100 and a serial inkjet recording apparatus 200. The PC 100 is a terminal including computer components such as a central processing unit (CPU), a read only memory (ROM), and a random access memory (RAM). In the PC 100, the CPU loads basic software and applications from the ROM or a hard disk drive (HDD) into the RAM and executes the basic software and applications, in response to an activation instruction from an operating unit. Image processing is then performed with the functions thus implemented. Further, the PC 100 instructs the serial inkjet recording apparatus 200 to perform printing, via a communication interface, and outputs print data. The image processing in the PC 100 and the print data to be output to the serial inkjet recording apparatus 200 will be described later.

Figure 2:
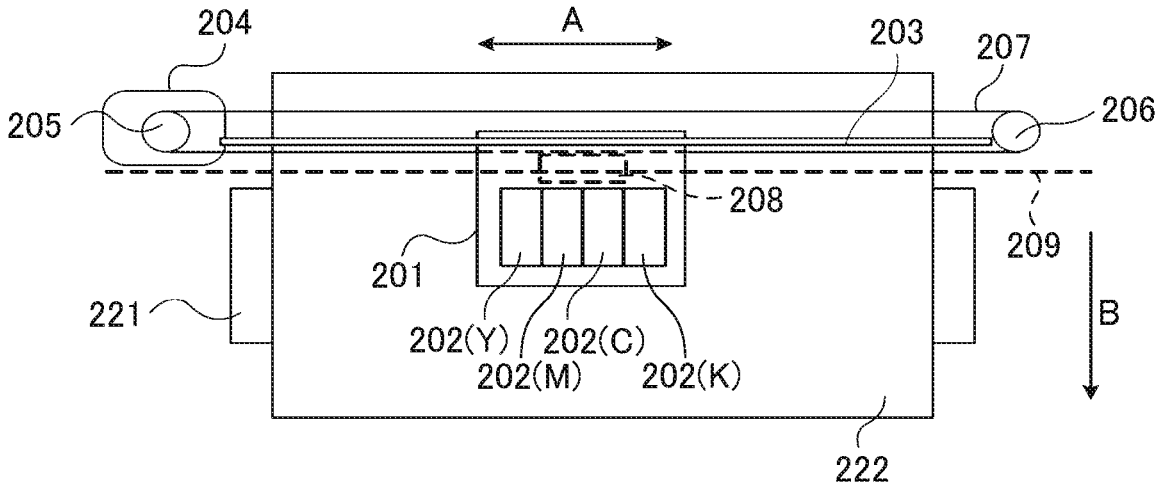
FIG. 2 is a view illustrating a general arrangement of a serial inkjet recording apparatus.

FIG. 2 is a view plan illustrating a general arrangement of the serial inkjet recording apparatus 200. FIG. 2 schematically illustrates the general arrangement of the serial inkjet recording apparatus 200.

Inkjet recording heads (hereinafter referred to simply as "ink heads") 202 of the respective colors are mounted on a carriage 201. The ink heads 202 discharge inks (liquids) of the respective colors such as monochrome and color inks as ink droplets (liquid droplets). FIG. 2 illustrates an example in which four-color ink heads that discharge inks of the respective colors of Y (yellow), M (magenta), C (cyan), and Bk (black) are arranged. Each ink head 202 has a nozzle face on which a large number of discharge nozzles are arranged, and causes each discharge nozzle to discharge ink droplets.

The carriage 201 is supported by a guide rod 203 to reciprocate in the direction indicated by arrow A (hereinafter "main scanning direction A") in FIG. 2. Driven by a main scanning motor 204 (a carriage motor), the carriage 201 reciprocates for scanning in the main scanning direction A as a timing belt 207 supported by a driving shaft 205 and a driven shaft 206 rotates. The carriage 201 is provided with an encoder sensor 208. The position of the carriage 201 in the main scanning direction A is detected by the encoder sensor 208 reading a linear scale 209 (an encoder sheet) extending in the direction of movement of the carriage 201.

A platen 221 is disposed at a position facing the nozzle faces of the ink heads 202. While being attracted by the platen 221, a recording sheet 222 to which liquid can adhere is sent in the direction indicated by arrow B (hereinafter "sub-scanning direction B") by a conveyance mechanism hidden behind the recording sheet 222.

Accordingly, the serial inkjet recording apparatus 200 illustrated in FIG. 2 alternately repeats scanning of the carriage 201 in the main scanning direction A and conveyance of the recording sheet 222 in the sub-scanning direction B. In that process, the serial inkjet recording apparatus 200 discharges ink droplets onto the recording sheet 222, thereby forming an image with dots of ink droplets on the recording sheet 222.

Figure 3A:
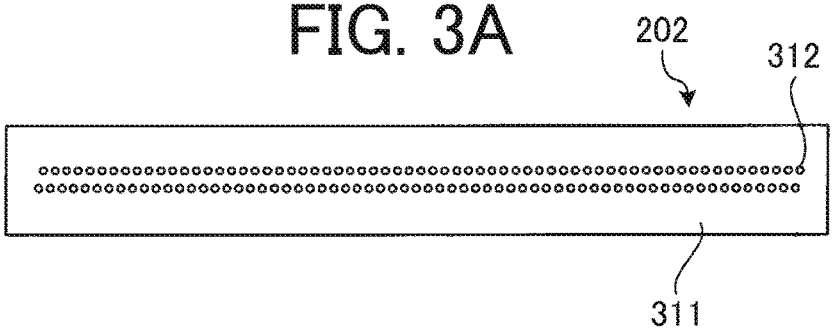
FIGS. 3A and 3B are views of an example of an ink head of the inkjet recording apparatus illustrated in FIG. 2.
Figure 3B:
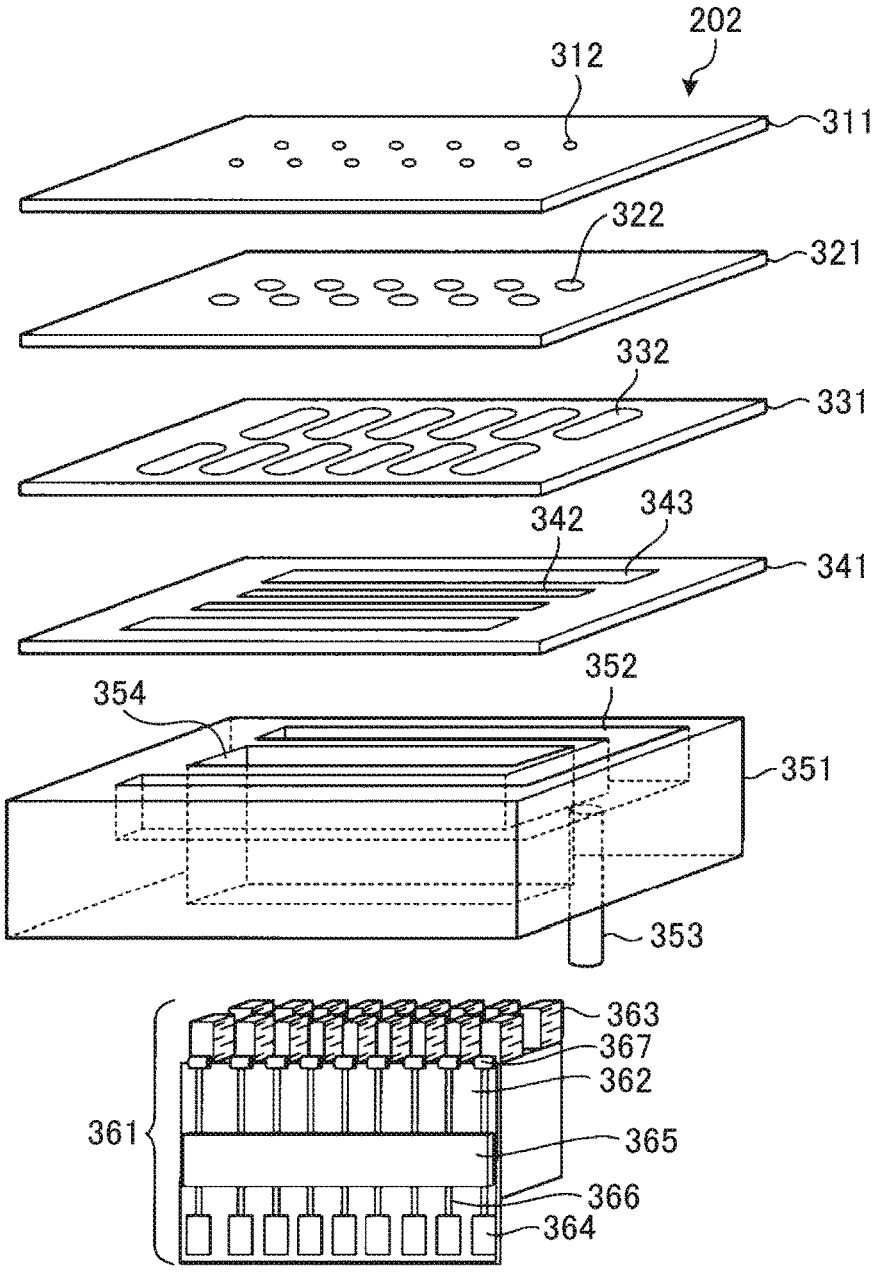

FIGS. 3A and 3B are views of an example of the ink head 202. FIG. 3A illustrates an example of the discharge nozzle arrangement on the nozzle face (also referred to as the nozzle plate) of the ink head 202. FIG. 3B illustrates an exploded view of the ink head 202.

FIG. 3A illustrates discharge nozzles 312 arranged in a staggered pattern on a nozzle plate 311 (the nozzle face). As an example, the discharge nozzles 312 are arranged in two columns and 64 rows. Such a large number of discharge nozzles 312 arranged in a staggered pattern meets high-resolution image formation.

Next, the structure of the ink head 202 is described with reference to FIG. 3B. Note that, in FIG. 3B, the number of the discharge nozzles 312, the number of pressure chambers 322, the number of restrictors 332, the number of piezoelectric elements 363, and the like are reduced for ease of understanding of principal components of the ink head 202.

The ink head 202 includes the nozzle plate 311, a pressure chamber plate 321, a restrictor plate 331, a diaphragm plate 341, a rigid plate 351, and a piezoelectric element group 361.

The nozzle plate 311 is the plate in which the discharge nozzles 312 are formed and has the nozzle face. Formed in the pressure chamber plate 321 are pressure chambers 322. Formed in the restrictor plate 331 are the restrictors 332. The restrictors 332 connect a common ink channel 352 to the pressure chambers 322 and controls the flow rate of the ink to be supplied into the pressure chambers 322. Formed in the diaphragm plate 341 are diaphragms 342 and filters 343. The pressure chamber plate 321, the restrictor plate 331, and the diaphragm plate 341 are sequentially stacked, positioned, and joined to each other, to form a channel substrate. The channel substrate is joined to the rigid plate 351, and the filters 343 are made to face the opening of the common ink channel 352. The upper open end of an ink introduction pipe 353 is connected to the common ink channel 352 of the rigid plate 351, and the lower open end of the ink introduction pipe 353 is connected to the ink tank of the corresponding color.

The piezoelectric element group 361 constructed of a large number of piezoelectric elements 363 arranged on a piezoelectric element supporting substrate 362 is inserted through an opening 354 in the rigid plate 351, and the free ends of the respective piezoelectric elements 363 are bonded and secured to the diaphragms 342. Thus, the ink head 202 is formed.

Electrode pads 364 for connecting to a drive control board 30 (see FIG. 4) are provided on the piezoelectric element supporting substrate 362 and are electrically connected to the drive control board 30 by soldering. A piezoelectric element driving integrated circuit (IC) 365 that applies a drive waveform to the piezoelectric elements 363 in accordance with the command value of an image data signal serially transmitted from the drive control board 30 is also mounted on the piezoelectric element supporting substrate 362.

Note that the piezoelectric element driving IC 365 and each piezoelectric element 363 are electrically connected by a copper foil pattern 366. Meanwhile, piezoelectric element connecting electrode pads 367 are designed to electrically connect the piezoelectric elements 363 to the copper foil pattern 366, and bonding the piezoelectric elements 363 to the piezoelectric element supporting substrate 362.

As the ink head 202 has such a structure, ink droplets are discharged from the discharge nozzles 312 in accordance with the driving states of the piezoelectric elements 363 corresponding to the respective discharge nozzles 312. There are two kinds of driving states, which are driving and micro vibration driving, and ink droplets are discharged by driving.

Figure 4:
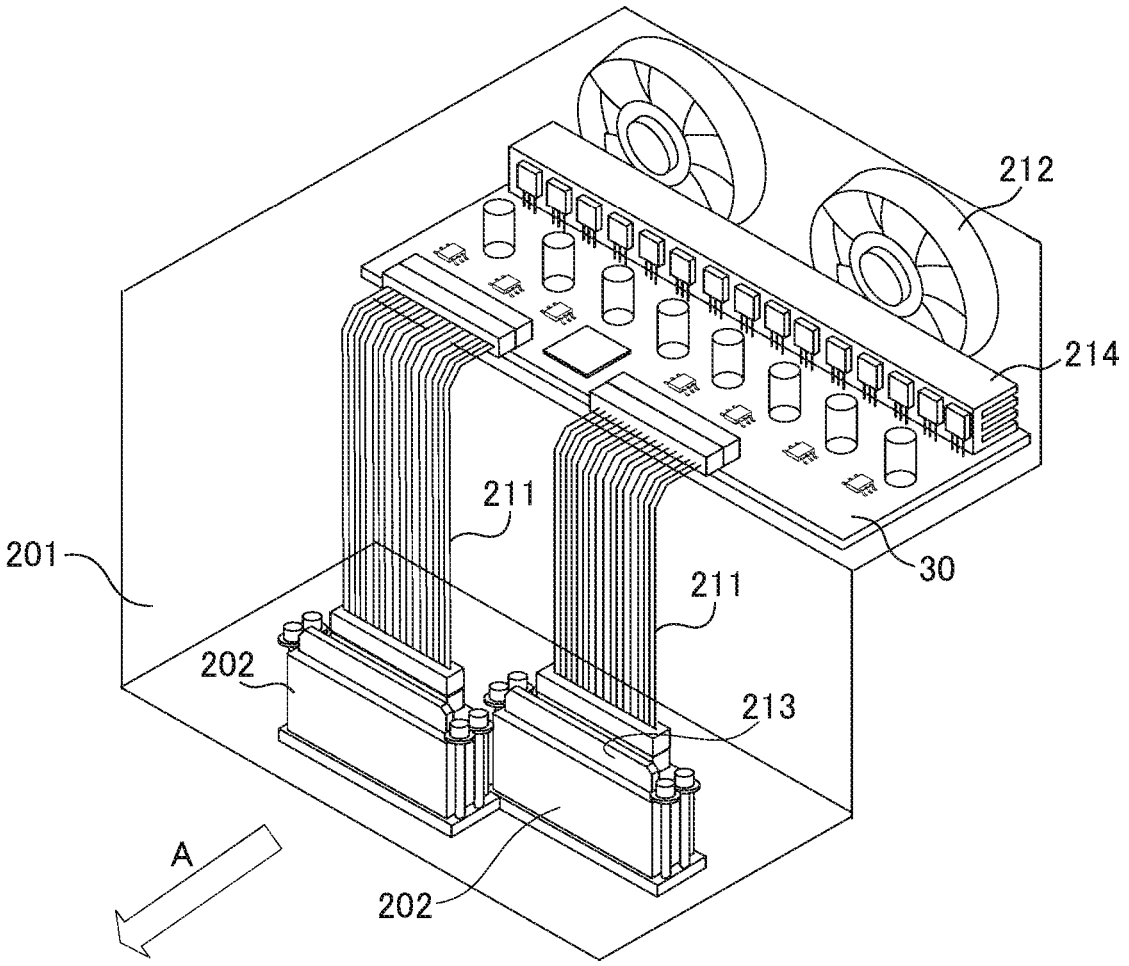
FIG. 4 is a view of an example of an internal structure of a carriage for the ink head illustrated in FIGS. 3A and 3B.

FIG. 4 is a view of an example of the internal structure of the carriage 201. The carriage 201 includes the drive control board 30, the ink heads 202, cables 211, and cooling fans 212. Here, the cooling fans 212 are an example of a "cooling device".

The ink heads 202 discharge ink droplets onto the recording sheet 222 in accordance with the command values of a drive waveform signal and an image data signal transmitted from the drive control board 30 through the cables 211. Although FIG. 4 illustrates an example in which two ink heads 202 are mounted on the carriage 201, the other ink heads 202 are not illustrated in FIG. 4. Further, the arrangement and the number of the ink heads 202 are not limited to those illustrated in FIG. 4.

The cooling fans 212, head cooling fins 213, and a substrate cooling fin 214 take away the heat generated as the ink heads 202 are driven.

Figure 5:
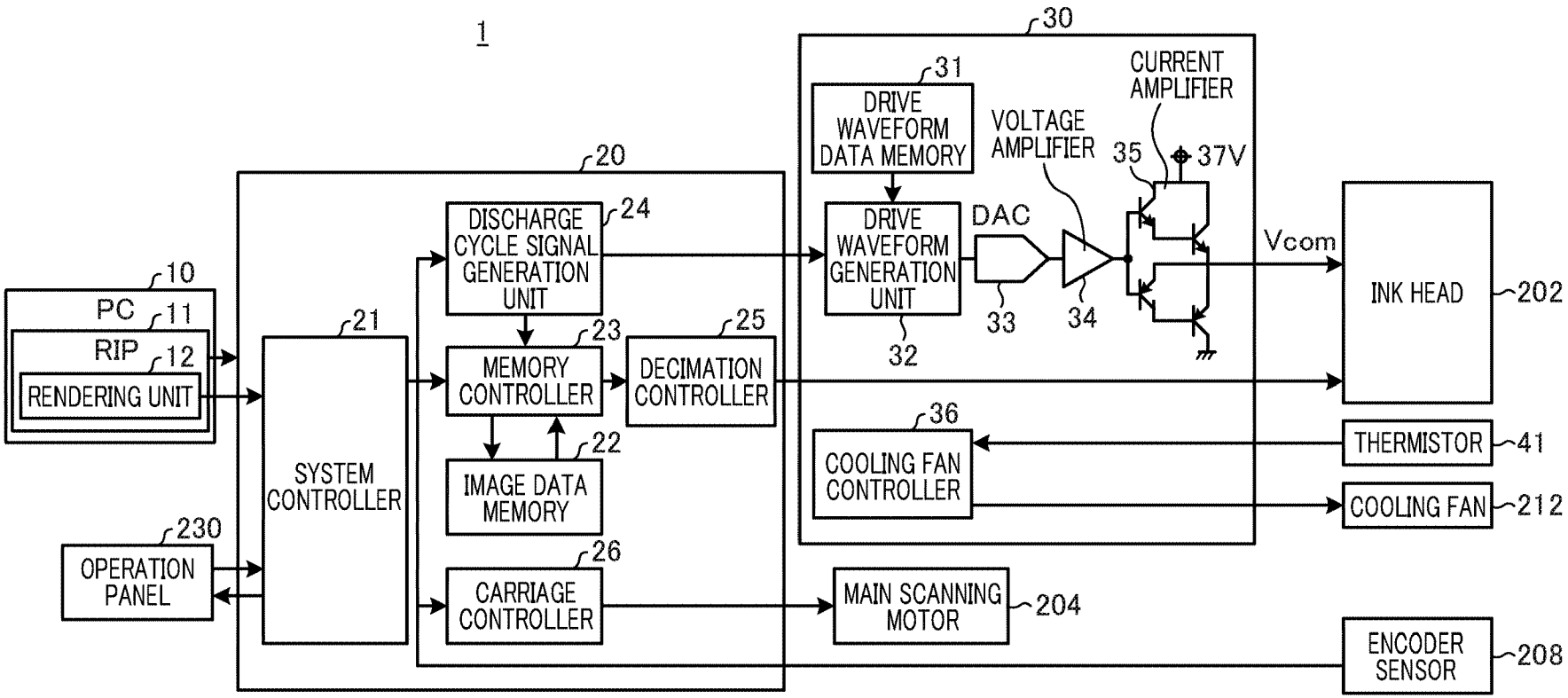
FIG. 5 is a block diagram illustrating an example configuration of system blocks of the liquid discharge system.

FIG. 5 is a block diagram illustrating an example of system configuration of the liquid discharge system 1. FIG. 5 illustrates primarily the system blocks between a PC board 10, a main controller board 20, and the drive control board 30. The drive control board 30 is mounted on the carriage 201. Note that the mounting positions of the respective blocks in the main controller board 20 and the drive control board 30 are not limited to those illustrated in FIG. 5. For example, a part or all of the drive control board 30 may be mounted on the main body of the serial inkjet recording apparatus 200 outside the carriage 201.

A routing information protocol (RIP) 11 is formed as a functional unit as software installed in the PC 100 is implemented. The RIP 11 performs image processing in accordance with a color profile and user's setting, and issues a printing instruction to the main controller board 20. A rendering unit 12 is a functional module of the RIP 11, divides a print image into pieces of image data corresponding to respective scans in accordance with the print settings, and outputs information about a decimation pattern. The rendering unit 12 is equivalent to a "dividing unit" and a "pattern data output unit". The information about the decimation pattern is equivalent to "pattern data". The information about the decimation pattern will be hereinafter referred to as the "decimation pattern".

An operation panel 230 is a user interface of the serial inkjet recording apparatus 200. The operation panel 230 includes an operating unit and a display unit.

A system controller 21 controls the entire printer system. For example, the system controller 21 receives print information from the RIP 11, in accordance with a printing instruction transmitted from the RIP 11, and performs printing by controlling the respective components. In this embodiment, the system controller 21 receives information such as the resolution set in the print settings, image data, and the decimation pattern from the rendering unit 12, controls the respective components in accordance with the information, and performs printing.

An image data memory 22 is a memory for temporarily storing image data transmitted from the rendering unit 12.

A memory controller 23 stores image data in the image data memory 22. The memory controller 23 also reads image data from the image data memory 22 and outputs the image data to a decimation controller 25 (or an image data decimation controller).

A discharge cycle signal generation unit 24 includes a register that sets the decimation pattern transmitted from the rendering unit 12, and a register that sets a resolution. The discharge cycle signal generation unit 24 generates a discharge cycle signal using an output signal from the encoder sensor 208 in accordance with the decimation pattern and the resolution set in the respective registers, and outputs the generated discharge cycle signal to a drive waveform generation unit 32.

The decimation controller 25 thins out image data output from the memory controller 23 in accordance with the decimation pattern. In response to an output of a discharge cycle signal from the discharge cycle signal generation unit 24 to the drive waveform generation unit 32, the memory controller 23 reads image data from the image data memory 22 and outputs the image data and the decimation pattern set in a register to the decimation controller 25. In accordance with the decimation pattern, the decimation controller 25 thins out the image data that has been output together with the decimation pattern. Note that, in a case where the decimation pattern indicates no decimation, the decimation controller 25 does not thin the image data. The decimation controller 25 outputs the corresponding image data signal to the ink head 202. The image data signal is masked data that specifies the size (such as large droplets, medium droplets, or small droplets) of the ink droplets in the valid data of the image.

A carriage controller 26 includes a register that sets the decimation pattern transmitted from the rendering unit 12, and a register that sets a resolution. The carriage controller 26 controls the main scanning motor 204 in accordance with the decimation pattern and the resolution set in the respective registers. The position of the carriage 201 is calculated in accordance with an output signal from the encoder sensor 208.

A drive waveform data memory 31 stores the drive waveform corresponding to the ink head 202.

In response to an input of a discharge cycle signal output from the discharge cycle signal generation unit 24, the drive waveform generation unit 32 outputs a drive waveform read from the drive waveform data memory 31 as drive waveform data to a digital-to-analog (D/A) converter 33 (represented as "DAC 33" in FIG. 5).

The D/A converter 33 converts the drive waveform data into an analog signal. A voltage amplifier 34 (an operational amplifier) amplifies the voltage of the analog signal output from the D/A converter 33. A current amplifier 35 amplifies the current of the driving waveform voltage output from the voltage amplifier 34 (the operational amplifier), and supplies the drive waveform subjected to the current amplification to each piezoelectric element 363 (see FIG. 3B) in the ink head 202.

A thermistor 41 detects heat generated in the ink head 202. A cooling fan controller 36 (a cooling controller) controls the cooling fans 212 in accordance with the temperature detected by the thermistor 41.

Rendering Process

In a case where the resolution set in the print settings is as high as 1200 dpi, the distance between the dots of ink droplets formed on the recording sheet 222 (see FIG. 2) is short. Therefore, adjacent ink droplets merge. To prevent such merging, adjacent dots are formed in a plurality of scans on the sheet to gain, with the time lags, the time for drying the adjacent ink droplets.

In accordance with an instruction from the RIP 11, the rendering unit 12 performs a rendering process to divide the image to be printed into pieces of image data corresponding to the respective scans.

Figure 6:
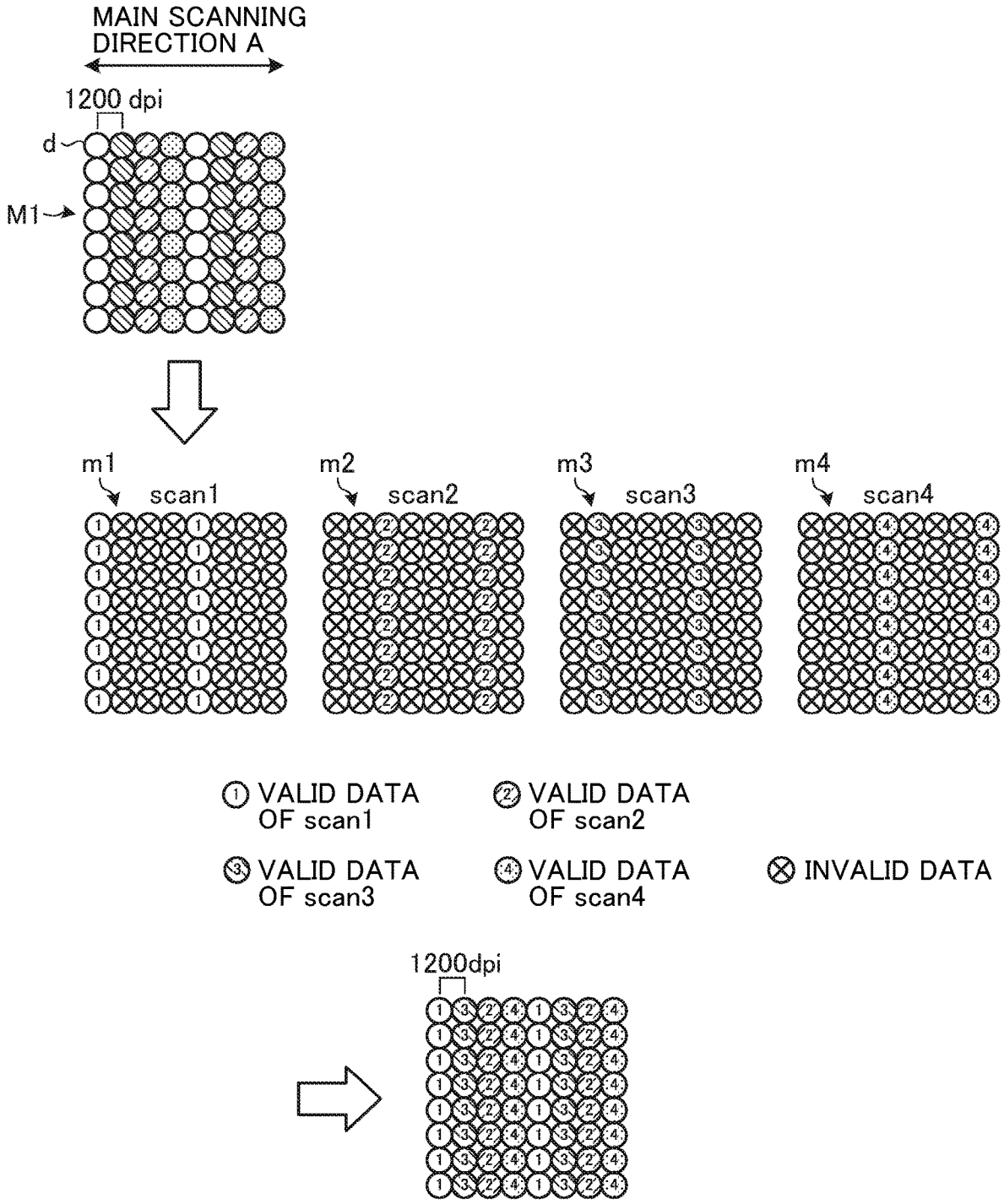
FIG. 6 is a diagram illustrating a rendering process performed by a rendering unit according to an embodiment.

FIG. 6 is a diagram illustrating a rendering process to be performed by the rendering unit 12. An original image M1 illustrated in FIG. 6 is a two-dimensional image of an image with a high resolution (1200 dpi, for example). Each dot d represents one dot that is printed at intervals of 1200 dpi in the main scanning direction A. In a case where the original image M1 is a solid image, the data of the respective dots is all valid data, and, if thinning is performed on this data, image quality becomes lower. The same effect can be achieved in a case where a part of the valid data is invalid data as in a case where the original image is not a solid image. However, for ease of explanation, all data of dots in the original image M1 is valid in the description below.

By the above rendering process, the rendering unit 12 divides the original image M1 into pieces of image data (divided images m1, m2, . . . ) of the respective scans as illustrated in FIG. 6. The number of divided images m1, m2, . . . varies depending on the intervals at which the valid data is printed in the scan. For ease of explanation of the principles, FIG. 6 illustrates the original image M1 that has 8-dot data in the main scanning direction A. As for the divided images m1, m2, . . . , four divided images m1, m2, m3, and m4 are illustrated as the divided images obtained in a case where the original image M1 is formed by repeating scanning in the main scanning direction A four times (or through four passes). The four divided images m1, m2, m3, and m4 are an example of divided images in such a combination that no adjacent dots are printed in the same pass. The combination is specified by the RIP 11 or the like, and the rendering unit 12 selectively performs the dividing.

The respective divided images m1, m2, m3, and m4 are the image data respectively corresponding to first, second, third, and fourth scans scan1, scan2, scan3, and scan4, which are in the order of scanning in the same area (the same area in a certain row). To clearly indicate in which pass each dot is printed, scan numbers "1", "2", "3", and "4" are given in the dots indicating the valid data in the respective divided images m1, m2, m3, and m4, for ease of explanation. In each of the divided images m1, m2, m3, and m4, the dots without any scan number are invalid data added by the rendering unit 12. The invalid data is data not to be printed as dots, and a signal for micro vibration driving is output to the ink heads 202 so that no ink is discharged during the periods of the invalid data.

As described above, the divided images m1, m2, m3, and m4 are formed with valid data for discharging ink droplets and invalid data for discharging no ink droplets. Through the four passes, the valid data of the respective divided images m1, m2, m3, and m4 is sequentially formed on the sheet surface, and the image corresponding to the original image M1 is formed on the sheet surface. FIG. 6 also presents an image in which all the dots are printed on the sheet so that the relationship between the respective dots in the image on the sheet and the divided images m1, m2, m3, and m4, which are used to form the dots, becomes obvious. Scan numbers indicating the sequence in dot formation are given to the respective dots.

The rendering unit 12 further outputs a decimation pattern of a rendering pattern to which the invalid data is added for each of the divided images m1, m2, m3, and m4. The decimation pattern is a pattern indicating the position of the invalid data in the rendering pattern. In this example, the valid data of the divided images to be used in the respective scans scan1, scan2, scan3, and scan4 is arranged as illustrated in FIG. 6. Therefore, the respective decimation patterns of scans scan1, scan2, scan3, and scan4 are "0x88", "0x22", "0x44", "0x11", respectively. Note that each decimation pattern is in hexadecimal representation.

These decimation patterns, the image data of the respective divided images, and the resolution set in the print settings are transmitted from the rendering unit 12 to the system controller 21.

Generation of Discharge Cycle Signal

Figure 7A:
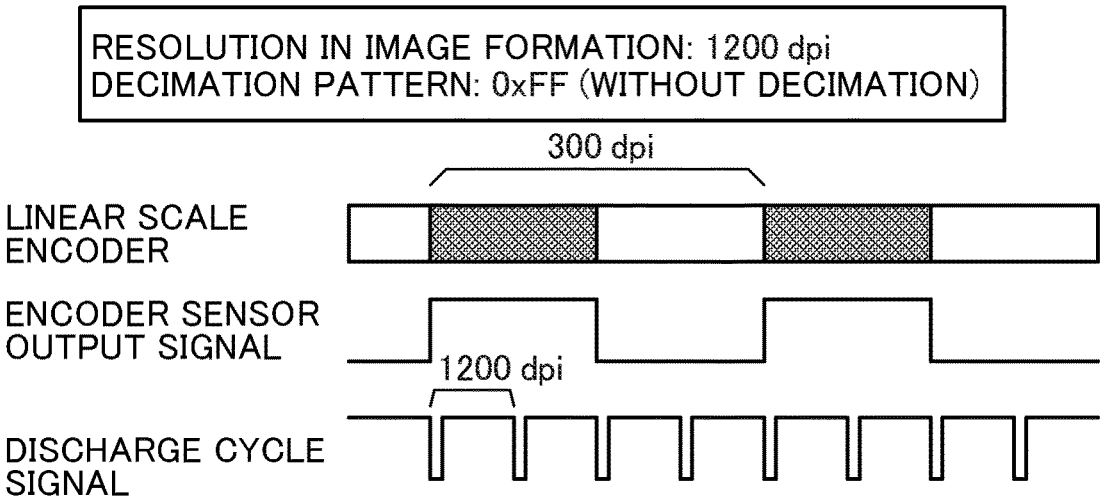
FIGS. 7A and 7B are diagrams illustrating generating of a discharge cycle signal by a discharge cycle signal generation unit according to an embodiment.
Figure 7B:
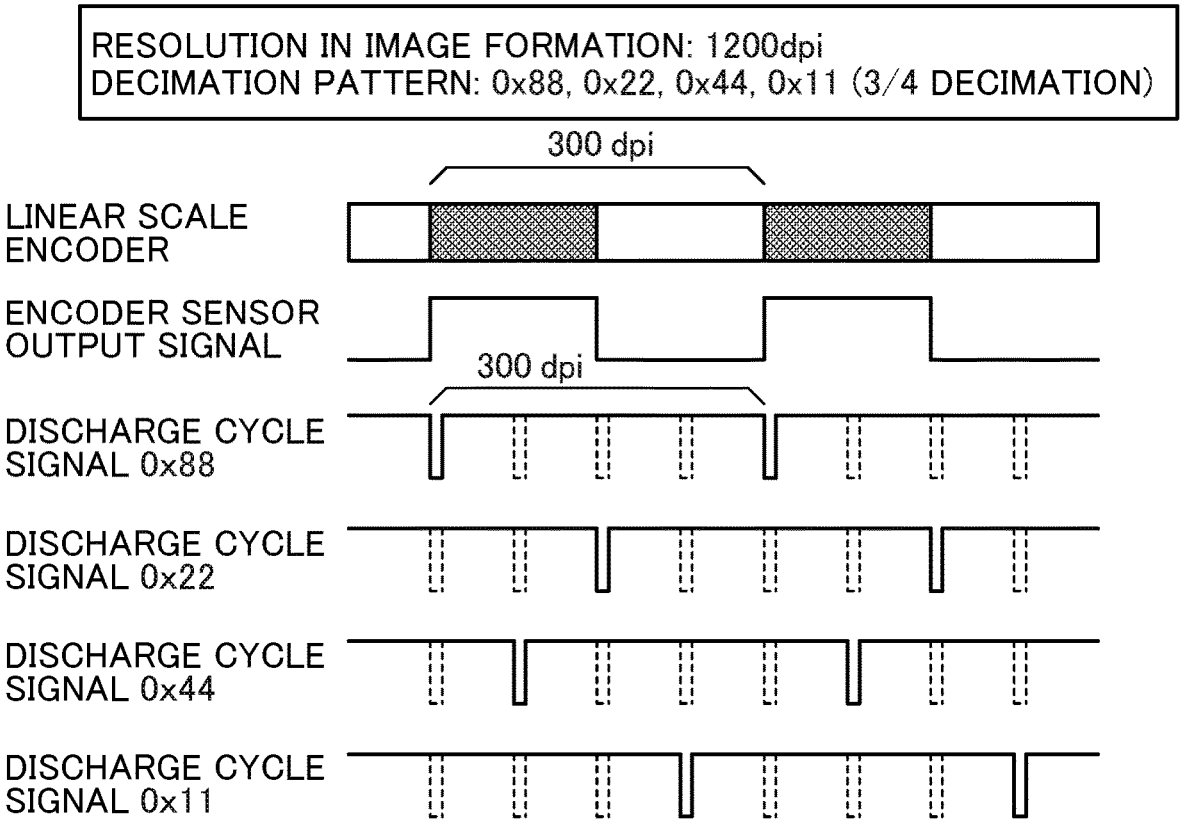

FIGS. 7A and 7B are diagrams illustrating generation of a discharge cycle signal by the discharge cycle signal generation unit 24. The discharge cycle signal generation unit 24 generates the discharge cycle signal using an output signal from the encoder sensor 208, in accordance with the decimation pattern and the resolution set in the registers. FIGS. 7A and 7B illustrate discharge cycle signals with the resolution of 1200 dpi without decimation (FIG. 7A) and with decimation (FIG. 7B). In each of FIGS. 7A and 7B, a timing chart illustrates an example of output signals from the linear scale 209 and the encoder sensor 208, and a discharge cycle signal generated by the discharge cycle signal generation unit 24. The linear scale 209 is compatible with a pattern cycle corresponding to 300 dpi, for example.

In the case without any decimation pattern illustrated in FIG. 7A, to generate a discharge cycle signal of 1200 dpi, the discharge cycle signal generation unit 24 generates a discharge cycle signal illustrated in FIG. 7A from an output signal from the encoder sensor 208. The ink heads 202 perform driving for discharge (such as driving to discharge large droplets, or micro vibration driving) at the timing of each rise.

In the decimation patterns ("0x88", "0x22", "0x44", and "0x11") illustrated in FIG. 7B, the decimation controller 25 outputs image data generated by decimating the invalid data from the respective divided images m1, m2, m3, and m4 in accordance with the respective decimation patterns. Accordingly, the discharge cycle signal generation unit 24 generates discharge cycle signals corresponding to the respective decimation patterns. In FIG. 7B, the discharge cycle signals indicated by combinations of a solid line and a dashed line are equivalent to the discharge cycle signal illustrated in FIG. 7A. The discharge cycle signals indicated only by the solid lines are the discharge cycle signals subjected to decimation performed in accordance with the respective decimation patterns. As the discharge cycle signals are decimated in this manner and the discharge timing is shifted for each scan, discharge driving can be performed only with valid data in each scan.

Decimation Process

In response to an output of a discharge cycle signal generated by the discharge cycle signal generation unit 24, the memory controller 23 reads image data divided for the respective scans from the image data memory 22 at the output timing of the discharge cycle signal, and transfers the discharge cycle signal, together with the decimation pattern used in generating the discharge cycle signal, to the decimation controller 25.

Figure 8A:
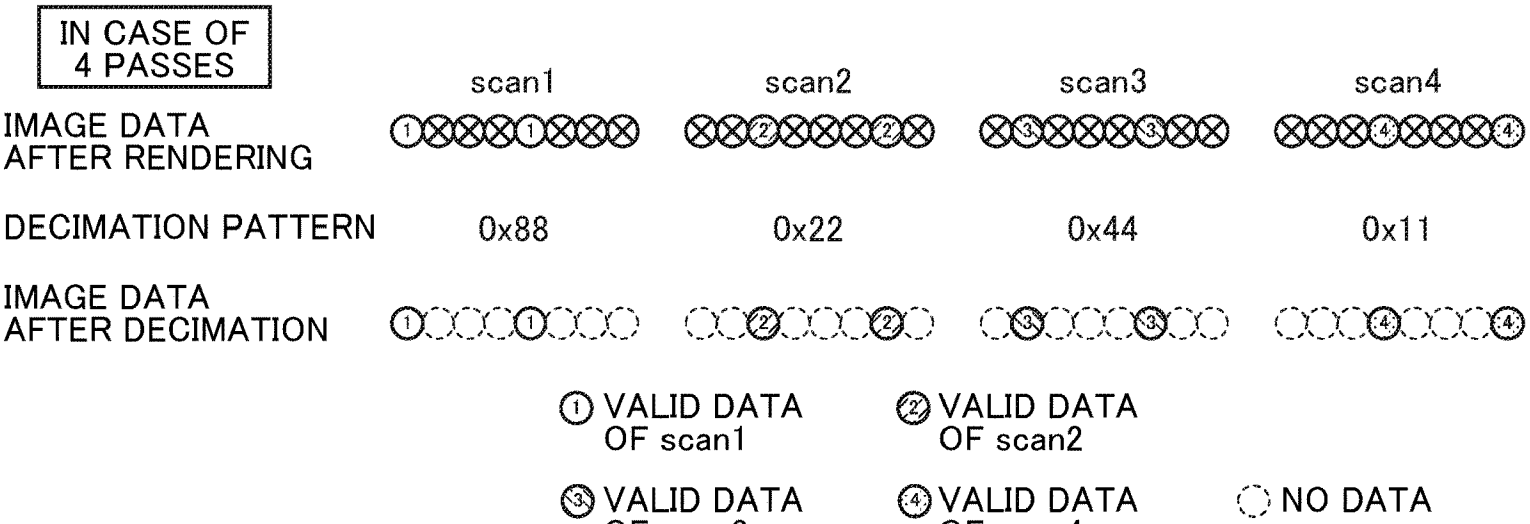
FIGS. 8A and 8B are diagrams illustrating an example of a decimation process in a decimation controller.
Figure 8B:
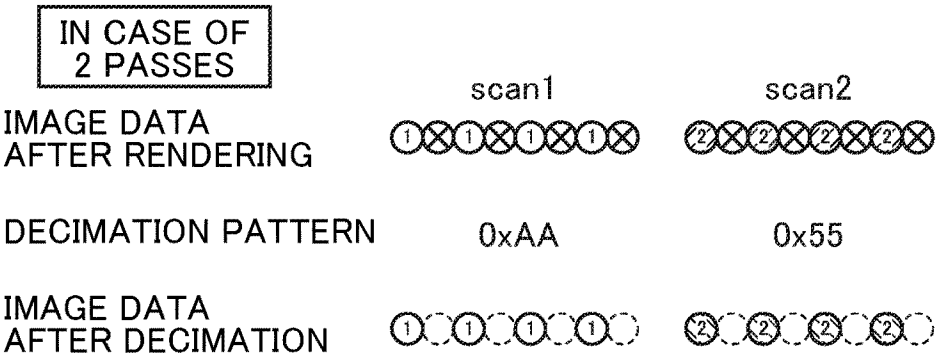

FIGS. 8A and 8B are diagrams illustrating an example of a decimation process in the decimation controller 25. As illustrated in FIG. 8A, image data subjected to rendering is a rendering pattern in which eight dots in the main scanning direction A are completed through four passes (the scans scan1, scan2, scan3, and scan4) in this example. Accordingly, the respective decimation patterns are expressed as "0x88", "0x22", "0x44", and "0x11". The decimation controller 25 periodically decimates the invalid data (added invalid data) from the image data (the divided images m1, m2, m3, and m4) sequentially read at the predetermined timings from the image data memory 22, in accordance with the respective decimation patterns. The dots indicated by dashed lines in FIG. 8A represent the dots from which data is decimated.

Specifically, as illustrated in FIG. 8A, the decimation controller 25 performs decimation on rendered image data, in accordance with the respective decimation patterns. In this example, the decimation patterns are designed to decimate the valid data, which is ¾ of the divided images m1, m2, m3, and m4. Therefore, all the invalid data added by the rendering unit 12 are decimated at this point, and only the valid data forming the original image M1 remains.

A decimation process using other decimation patterns is now described. FIG. 8A illustrates an example of decimation patterns with which the decimation controller 25 decimates the invalid data, which is ¾ of the divided images m1, m2, m3, and m4, but some other decimation patterns may be used. Some other decimation patterns such as ⅔ or ¼ decimation patterns may be used, as long as the decimation controller 25 decimates the invalid data in accordance with the decimation patterns. For example, other optimum patterns may be output depending on the resolution set in the print settings, the sequence in image formation, and the like.

FIG. 8B illustrates an example of decimation in a case where eight dots are completed in two passes (the scans scan1 and scan2). In FIG. 8B, the respective decimation patterns are expressed as "0xAA" and "0x55". As illustrated in FIG. 8B, in the case of two passes, dot printing is performed every other dot, and an image is completed through two scans. Decimation is performed in accordance with the decimation patterns for the respective passes, and the invalid data represented by the dots indicated by dashed lines in FIG. 8B is decimated.

Carriage Control

FIG. 9 is a diagram illustrating an example operation of the carriage controller 26. The carriage controller 26 selects the carriage speed corresponding to the resolution and the decimation pattern from a speed correspondence table illustrated in FIG. 9, and changes the speed of the carriage 201. As illustrated in FIG. 9, even if the resolution is high, the speed of the carriage 201 is higher in a case where decimation is performed than in a case where no decimation is performed. For example, when image formation with a resolution of 1200 dpi is performed without decimation, the speed of the carriage 201 is only 200 mm/s. However, when the same image formation is performed with ½ decimation (corresponding to FIG. 8B), the speed increases to 400 mm/s. When the same image formation is performed with ¾ decimation (corresponding to FIG. 8A), the speed is as high as 800 mm/s. That is, high-speed printing can be performed with a high resolution. Furthermore, the valid data is not decimated. Accordingly, degradation of image quality can be prevented. The same applies to a case where image formation with a resolution of 600 dpi is performed.

Figure 10A:
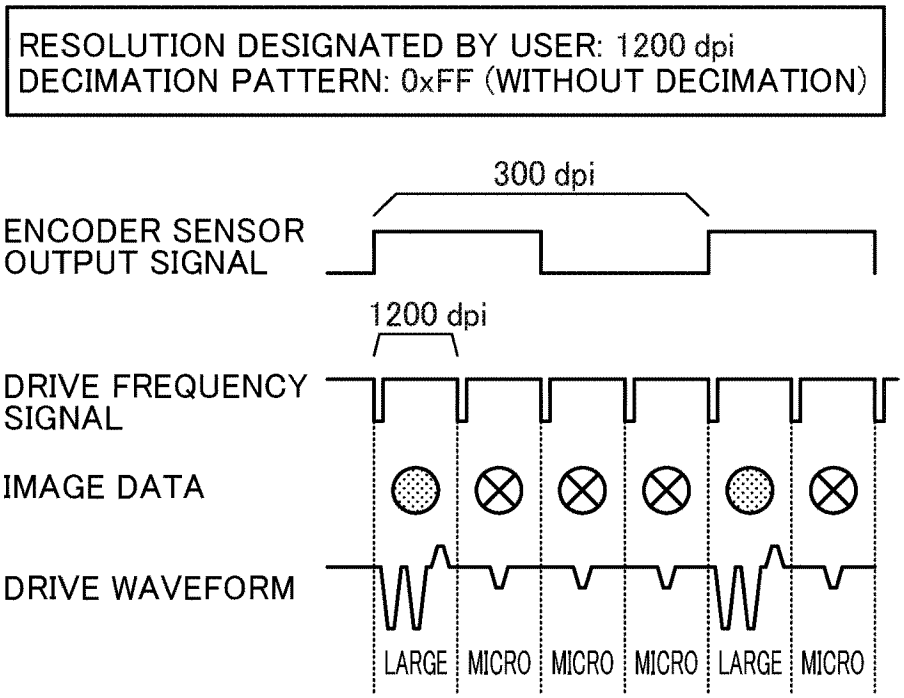
FIGS. 10A and 10B are comparative diagrams illustrating the differences between an operation in which invalid data is not decimated in divided images, and an operation in which invalid data is decimated in the divided images.
Figure 10B:
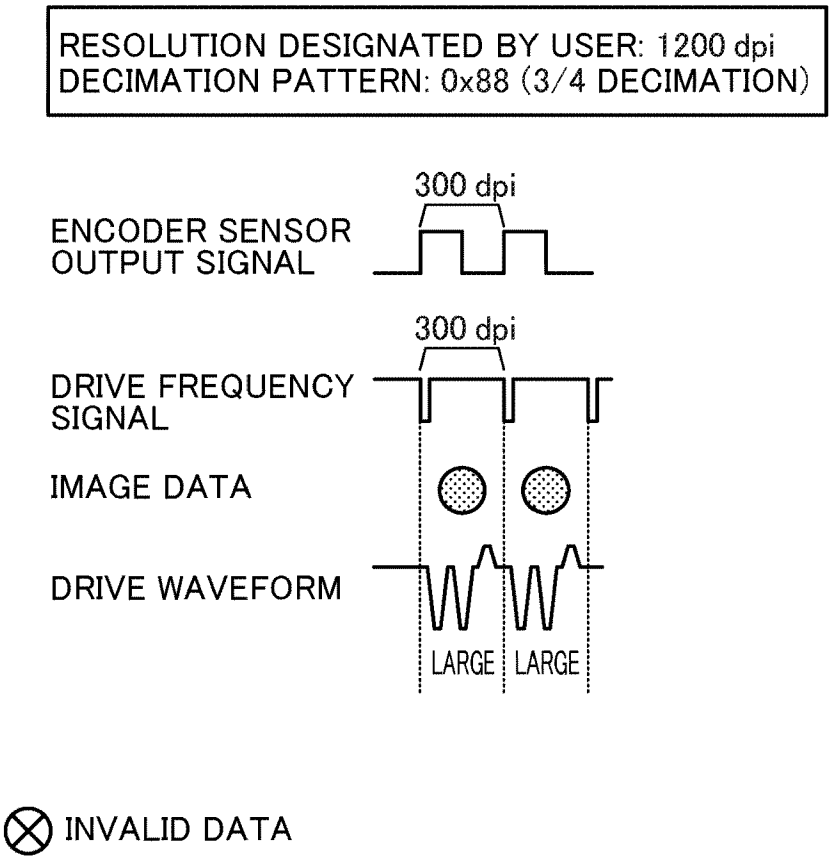

FIGS. 10A and 10B are comparative diagrams illustrating the differences between an operation in which invalid data is not decimated in divided images m1, m2, . . . , and an operation in which invalid data is decimated in the divided images m1, m2, . . . . Note that the periods given reference character "micro" in FIGS. 10A and 10B are the micro vibration periods of invalid data. The periods given reference character "large" are the driving periods during which large droplets are discharged.

In FIGS. 10A and 10B, in the case where no decimation is performed, driving needs to be performed four times for each discharge action. Therefore, the speed of the carriage 201 is low. In the case where decimation is performed, the micro vibration driving for invalid data can be eliminated. Accordingly, the carriage 201 operates at a higher speed.

Normally, to increase the speed of a carriage, the maximum drive frequency of the ink heads needs to be made higher. This requires a very difficult technique, which leads to higher costs. In this embodiment, on the other hand, the invalid data in divided images is decimated, and the number of times a discharge cycle signal is output is reduced accordingly. Thus, the number of times of driving is only once for one discharge action, thereby enabling increases in the speed of the carriage (four times as high in this example) without any increase in the maximum drive frequency of the ink heads. As a result, productivity also increases.

As described above, this embodiment can attain a high head drive frequency without a decrease in resolution.

Figure 11:
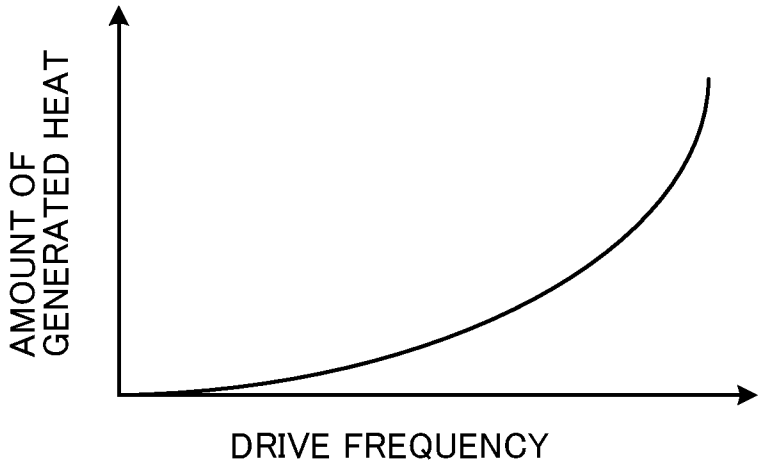
FIG. 11 is a graph and a chart illustrating a method of controlling cooling fans.

FIG. 11 is a graph and a chart illustrating a method of controlling the cooling fans 212. As illustrated in the graph in FIG. 11, as the drive frequency increases, the heat generated by the carriage 201 increases. It is known that, as the drive frequency increases, the amount of heat generated by the ink heads 202 and the drive control board 30 increases. This is because the electric current flowing per unit time increases. An approach to inhibit heat generation is keeping the drive cycle as is.

In a structure in which speed is not increased but is maintained, performing the decimation described above is advantageous in lowering the drive frequency and accordingly reducing the amount of heat generated. As the amount of heat generation decreases, the apparatus can be made compact. Normally, fins (see FIG. 4) for radiating heat, such as the head cooling fins 213 and the substrate cooling fins 214, are provided in each ink head and the drive control board. Further, the fins are cooled by the cooling fans 212. Since the amount of heat generated is large, such components are larger in size, increasing the cost.

The table in FIG. 11 illustrates the relationship between the decimation patterns and the power consumption by the cooling fans. As illustrated in FIG. 11, adopting the decimation described above can suppress heat generation and accordingly reduce the power consumption by the cooling fans. Further, the size of the fins and the like can be reduced, and the component costs and the like can be lowered.

Further, when the cooling fan controller 36 switches the driving of the cooling fans 212 in accordance with the decimation patterns, the power consumption can be reduced as illustrated in the table in FIG. 11.

Although the description above concerns an example in which an image is formed through a plurality of scans in the main scanning direction, the example is used for explaining principles of this disclosure. Alternatively, aspects of this disclosure can adopt to any appropriate method in which an image is formed in one of scanning the main scanning direction and scanning in the sub-scanning direction or combination thereof.

Embodiment 2

Figure 12:
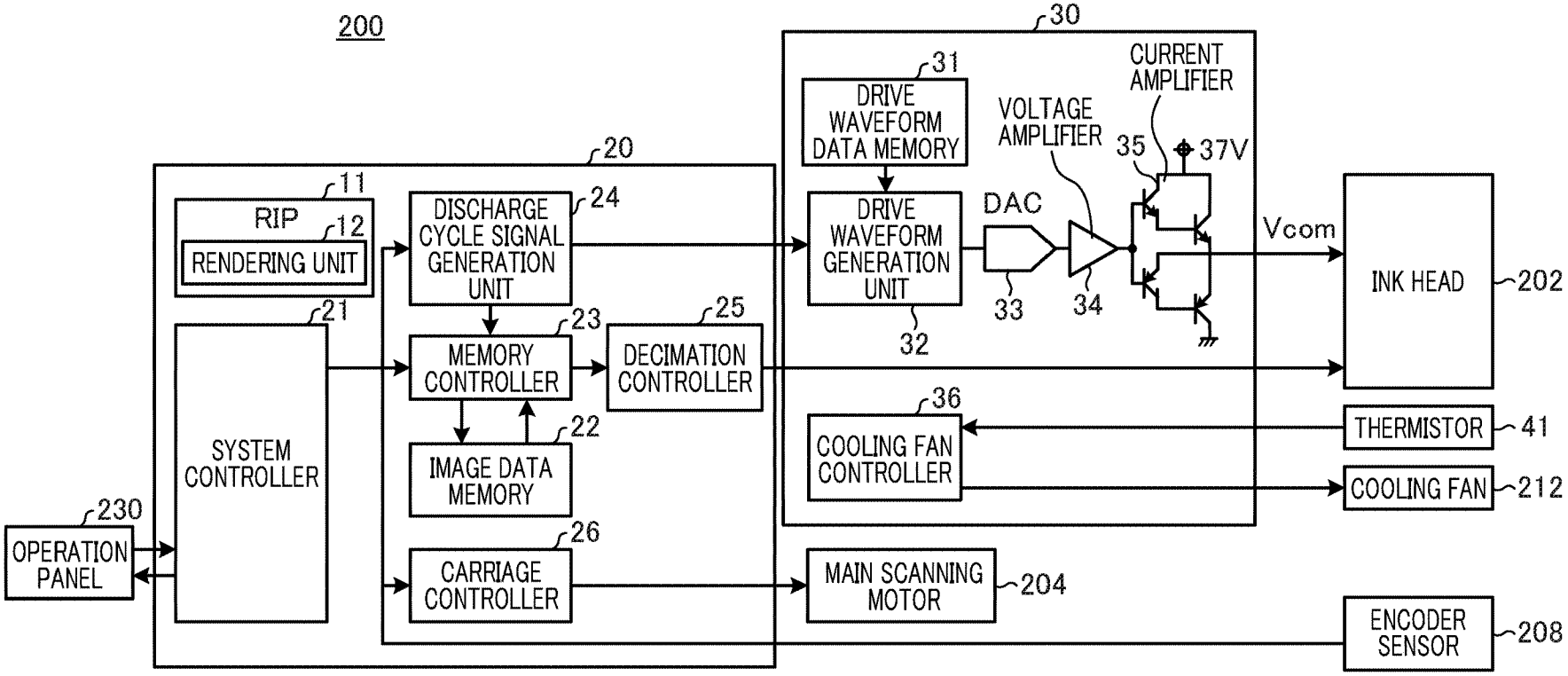
FIG. 12 is a diagram illustrating an example of a liquid discharge apparatus according to Embodiment 2. The accompanying drawings are intended to depict embodiments of the present invention and should not be interpreted to limit the scope thereof. The accompanying drawings are not to be considered as drawn to scale unless explicitly noted.

FIG. 12 is a block diagram illustrating an example of a liquid discharge apparatus according to Embodiment 2. FIG. 12 illustrates an example of system configuration of a serial inkjet recording apparatus 200 as an example of a liquid discharge apparatus. FIG. 12 differs from FIG. 5 in that the RIP 11 and the rendering unit 12 are mounted on the main controller board 20. That is, the serial inkjet recording apparatus 200 illustrated in FIG. 12 can perform a rendering process and the like on a printed image. The functions of the other components, the flow of signals, and the like are substantially the same as those of Embodiment 1, and redundant descriptions are omitted. The liquid discharge apparatus according to Embodiment 2 can achieve the same effects as the effects of the liquid discharge system according to Embodiment 1.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a liquid discharge head configured to discharge liquid when a drive waveform set in accordance with a value of image data is applied thereto in response to a discharge cycle signal;

a carriage on which the liquid discharge head is mounted, the carriage configured to scan the object in a predetermined direction; and processing circuitry configured to:

output pattern data for decimating the discharge cycle signal and the image data in accordance with a number of scans performed by the carriage to form a line of an image; and decimate the discharge cycle signal in accordance with the pattern data such that the discharge cycle signal switches once per scan.

2. The liquid discharge apparatus according to claim 1, wherein the processing circuitry is configured to decimate the image data in accordance with the pattern data.

3. The liquid discharge apparatus according to claim 2, wherein the processing circuitry is configured to divide the image data into a plurality of image data pieces corresponding to the number of scans performed by the carriage to form the line of the image.

4. The liquid discharge apparatus according to claim 3, wherein the pattern data includes a plurality of pattern data pieces respectively corresponding to the plurality of image data pieces, and wherein the processing circuitry is configured to selectively output corresponding one of the plurality of pattern data pieces for each of number of scans performed by the carriage to form the line of the image.

5. The liquid discharge apparatus according to claim 1, wherein the processing circuitry is configured to change a speed of the carriage in accordance with the pattern data.

6. The liquid discharge apparatus according to claim 1, further comprising a cooling device configured to cool the carriage, wherein the processing circuitry is configured to control the cooling device in accordance with the pattern data.

7. A liquid discharge system comprising:

the liquid discharge apparatus according to claim 1.

8. A liquid discharge apparatus comprising:

a liquid discharge head configured to discharge liquid onto an object when a drive waveform set in accordance with a value of image data is applied thereto in response to a discharge cycle signal;

a carriage on which the liquid discharge head is mounted, the carriage configured to scan the object in a predetermined direction; and processing circuitry configured to:

receive pattern data for decimating the discharge cycle signal and the image data in accordance with a number of scans performed by the carriage to form a line of an image; and decimate the discharge cycle signal in accordance with the pattern data such that the discharge cycle signal switches once per scan.

9. A liquid discharge system comprising:

the liquid discharge apparatus according to claim 8.

10. A method for discharging liquid onto an object with a liquid discharge head mounted on a carriage that scans the object in a predetermined direction, the method comprising:

discharging the liquid onto the object when a drive waveform set in accordance with a value of image data is applied thereto in response to a discharge cycle signal;

outputting pattern data for decimating the discharge cycle signal and the image data in accordance with a number of scans performed by the carriage to form a line of an image; and decimating the discharge cycle signal in accordance with the pattern data such that the discharge cycle signal switches once per scan.

* * * * *